US006145127A

United States Patent [19]

Wöhner et al.

[11] Patent Number: 6,145,127

[45] Date of Patent: Nov. 14, 2000

[54] CALENDER AND METHOD OF OPERATING SAME

[75] Inventors: Thomas Wöhner, Oberhausen; Joachim Hinz; Ralf Beckers, both of Kempen, all of Germany

[73] Assignee: Voith Sulzer Papiertechnik Patent GmbH, Heidenheim, Germany

[21] Appl. No.: 09/353,340

[22] Filed: Jul. 15, 1999

[30] Foreign Application Priority Data

Jul. 17, 1998 [DE] Germany ..... 198 32 214

[51] Int. Cl.[7] ..... D21G 1/00; B30B 3/04

[52] U.S. Cl. ..... 1/35; 100/162 R; 100/162 B; 100/163 A

[58] Field of Search ..... 100/35, 38, 47, 100/162 R, 163 A, 163 R, 162 B, 168, 170

[56] References Cited

U.S. PATENT DOCUMENTS

| | | | |
|---|---|---|---|
| 3,016,819 | 1/1962 | Kupka | 100/163 A |
| 4,332,192 | 6/1982 | Joutsjoki | 100/47 |
| 4,510,859 | 4/1985 | Berry | 100/35 |
| 4,890,551 | 1/1990 | Dahl et al. | 100/163 A |
| 5,029,521 | 6/1991 | Pav et al. | 100/38 |
| 5,806,415 | 9/1998 | Lipponen et al. | 100/35 |

FOREIGN PATENT DOCUMENTS 19633671 3/1998 Germany .

*Primary Examiner*—Peter Vo
*Assistant Examiner*—Louis Huynh
*Attorney, Agent, or Firm*—Greenblum & Bernstein, P.L.C.

[57] ABSTRACT

Calender having a frame having a roll stack therein and a lower deflection control roll as the lowermost roll of the roll stack. The lower deflection roll has a sleeve supported on a bracket having opposed ends. The lower deflection control roll further has a deflection control device configured to secure the bracket against rotation. The deflection control device is further configured to operate in the direction of a center place of the roll stack. The calender further has a pair of bearing blocks, each bearing block being configured to hold a respective end of the bracket. Each bearing block is adjustable by a respective loading device. The calender further includes a pair of pivoted arms each having a proximal end and a distal end, the proximal end swivelly connected to the frame, and the distal end connected to a respective bearing block. The calender also has a correction device having a guide element adapted to move along a guideway, the correction device adapted to adjust at least one of the bearing blocks. The operational direction of the deflection control device remains substantially constant when at least one of the bearing blocks are adjusted by the correction device. Also provided is a method of operating a calender. The method includes adjusting, via the connection device, the bearing block, and maintaining the operational direction of the deflection control device substantially constant.

18 Claims, 2 Drawing Sheets

CALENDER AND METHOD OF OPERATING SAME

CROSS REFERENCE TO RELATED APPLICATIONS

The present application claim priority under 35 U.S.C. § 119 of German Patent Application No. 198 32 214.3, filed on Jul. 17, 1998, the disclosure of which is expressly incorporated by reference herein in its entirety.

BACKGROUND OF THE INVENTION

1. Field of the Invention

The present invention relates to a calender having a frame and a roll stack, and more particularly to a calender having a lower deflection control roll device having a constant operational direction during adjustment.

2. Division of Background Information

A known calender is described in (German Patent Document No. DE 196 33 671 A1. This known calender is used for the treatment of paper and has a multiple roll stack having a vertical center plane. Bearing blocks for the lower roll (constructed as a deflection control roll) are held and guided on the frame in a linear guide. Beneath each of the bearing blocks, a loading device in the form of a hydraulic cylinder creates contact force exerted by the lower roll on the center rolls, which are mounted on levers above the lower roll. Contact force is also exerted on an immovably mounted upper roll. In this linear guide, frictional forces result which distort the loading forces and especially cause uneven loading at both roll edges.

Use of a pivoted arm substantially reduces the friction that results from movement of the bearing blocks of the lower roll. While use of this principle is known in conjunction with center rolls that are mounted on levers, when applying this principle to a lower roll that is constructed as a deflection control roll, the operating direction of the deflection control device (e.g. a series of hydrostatic support elements) changes. However, when the divergence of the operating direction of the center plane of the roll stack is more than about 1° or 1.5°, additional sleeve stresses occur which can reach unacceptable levels and correspondingly result in damage. This problem is especially prevalent in areas where the lower roll does not always have the same operational position, because the diameters of the rolls in the stack change, or because only the bottom nip is supposed to be closed while all other nips are open. The lower roll must then be raised far less than when all nips are supposed to be closed.

SUMMARY OF THE INVENTION

The present invention provides a calender and a method of operating a calender. The calender of the present invention has a frame having a roll stack therein, with a lower deflection control roll as the lowermost roll of the roll stack. The lower deflection roll has a sleeve supported on a bracket having opposed ends. The lower deflection control roll further has a deflection control device configured to secure the bracket against rotation. The deflection control device is further configured to operate in the direction of a center place of the roll stack. The calender further has a pair of bearing blocks, each bearing block being configured to hold a respective end of the bracket. Each bearing block is adjustable by a respective loading device. The calender further includes a pair of pivoted arms each having a proximal end and a distal end, the proximal end swivelly connected to the frame, and the distal end connected to a respective bearing block. The calender also has a correction device having a guide element adapted to move along a guideway, the correction device adapted to adjust at least one of the bearing blocks. The operational direction of the deflection control device remains substantially constant when at least one of the bearing blocks are adjusted by the correction device.

The guideway may be attached to the frame, and the guide element may be moved along with the bearing block. Also, the bearing block may be swivelly attached to the pivoted arm and the guide element of the correction device may be mounted to the bearing block.

Further, a correction lever fixedly connected to the bracket may be provided, and the bracket may be adapted for rotation in the bearing block by an angle. Also, the guide element of the correction device may be mounted to the correction lever, and the bearing block may be fixedly connected to the pivoted arm.

The guideway may be delimited on two sides. Additionally, the guideway may be a bearing surface against which the guide element may be held by a pressure system. The pressure system may include the loading device adapted to apply a force on a bearing block at a position outside a center plane of the lower deflection control roll. Further, the guideway may be linear and may be configured to form an angle of approximately 10° to 15° with a center plane of the roll stack. Also, the guide element may be a roller.

The method of operating a calender includes adjusting, via the correction device, the bearing block, and maintaining the operational direction of the deflection control device substantially constant. The method may further include moving the guide element with the bearing block.

The method may yet further include rotating the bracket in the bearing block by a predetermined angle. Also, the method may further include holding the guide element, via a pressure system, against the bearing surface. Holding the guide element via a pressure system may include applying force on a bearing block at a position outside a center plane of the lower deflection control roll. Also, the method may further include forming an angle of approximately 10° to 15° between the guideway and the center plane of the roll stack.

The present invention enables virtually frictionless movement of lower roll bearing blocks.

In the present invention, each bearing block is connected to a single pivoted arm, which is swivelly mounted on a frame. The operational direction of the deflection control device is consistently maintained when the bearing blocks are adjusted with the aid of a correction device having a guide element that can be moved along the length of a guideway.

In the present invention, when the bearing blocks of the lower roll are adjusted, the guide element moves along the guideway and acts on the deflection control device in such a way that the deflection control device maintains its operational direction.

The guideway may be attached to a frame and the guide element may be moveable along with a bearing block. Accommodation of the guideway on the frame does not cause any difficulties. Correction is triggered by the movement of the bearing block.

If a bracket is firmly connected to the bearing block at the ends thereof (as is usual), it is preferable for the bearing block to be flexibly connected to the pivoted arm and to carry the guide element.

The bearing block may alternatively be firmly connected to the pivoted arm. Also, the bracket in the bearing block may alternatively be pivotable about a predetermined angle, and for a correction lever carrying the guide element to alternatively be firmly connected to the bracket. Accordingly, the swing angle position of the bracket, which is responsible for the operational direction of the deflection control device, is changed directly by the correction lever.

The guideway may be delimited on two sides and may be embodied as a groove or a slot. This arrangement results in accurate guidance of the bearing block.

The guideway may also be formed by a bearing surface, against which the guide element is held by a pressure system. This arrangement leads to adjustment that is free from play.

Preferably, the pressure system is configured so that the forces for the loading device outside the center plane of the lower roll act on the bearing blocks. A minor lateral offset of the loading forces causes a more secure arrangement of the guide element on the guideway.

It would be ideal if the correction device were to exactly balance the circular arc of the lever motion. However, in most cases it is sufficient for the guideway to run in a straight line and to form a small angle of approximately 10° to 15° from the center planes of the roll stack.

It is further beneficial for the guide element to be a roller, which further reduces friction.

Other exemplary embodiments and advantages of the present invention may be ascertained by reviewing the present disclosure and the accompanying drawings.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
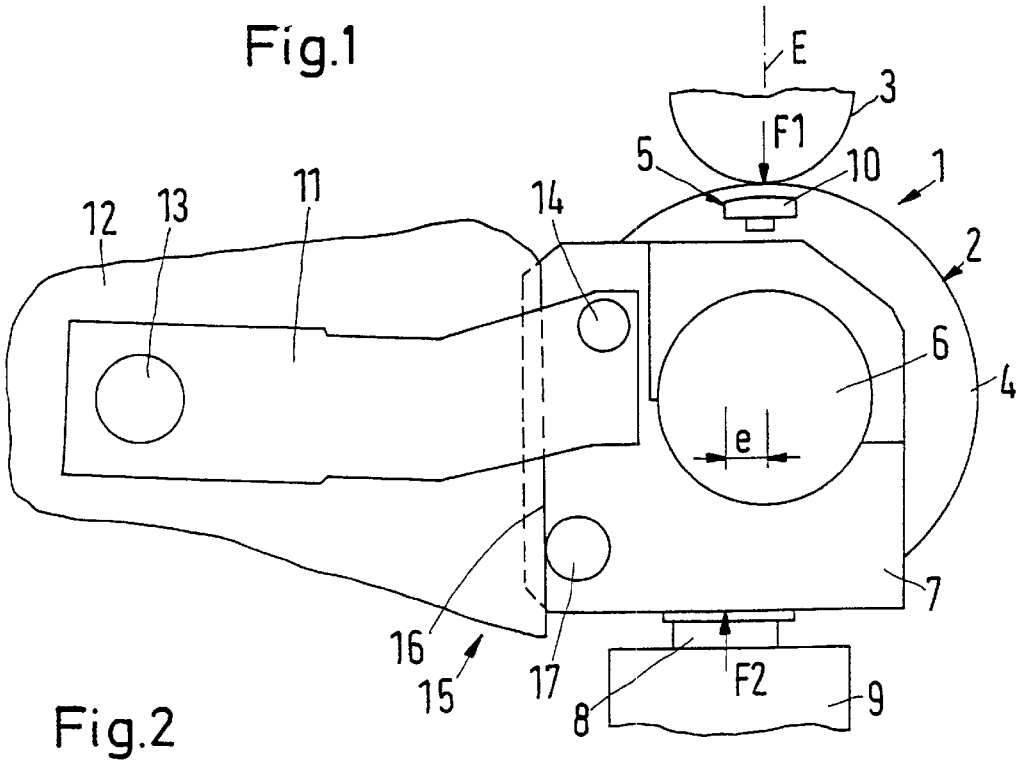
FIG. 1 shows a sectional view of a calender according to a first embodiment of the present invention.

Referring to the drawings wherein like numerals represent like elements, FIG. 1 shows a lower portion of a roll stack 1. Also shown are a lower roll 2 and a portion of an adjacent center roll 3. The lower roll 2 is embodied as a deflection control roll, and has a sleeve 4. The sleeve is supported by a deflection control device 5 on a bracket 6. Bracket 6 is fixedly clamped in a bearing block 7 and is therefore secured against rotation. Bearing block 7 can be loaded from below by a piston 8 of a loading device 9 in such a way that the rolls in the roll stack 1 can be moved toward one another and then correspondingly loaded by raising the bearing block 7.

The deflection control device 5 is depicted schematically for illustrative purposes. In the current embodiment, the deflection control device 5 includes a series of support elements 10, which are arranged in a radially moveable manner on the bracket 6, which determines the direction of operation, which is intended to coincide with a center plane "E" of the roll stack. However, other types of deflection control devices may also be considered in alternative embodiments, for example, a roll having pressure chambers between the bracket 6 and the sleeve 4, which are closed of by axial and radial seals.

A pivoted arm 11 having a proximal end and a distal end may be pivoted about a swivel pin 13 of the proximal end, the pin being firmly mounted on a frame 12. The swivel pin holds the bearing block 7 on the distal end of the pivoted arm 11 by a joint 14. As a correction device 15, a straight guideway 16, having a small incline towards the center plane "E" of the roll stack 1, is provided on the frame 12. A guide element 17 in the form of a roller, which is arranged on the bearing block 7, can be moved alone the guideway 16. The roller 17 is securely pressed against the guideway 16 because loading force F2 is offset by predetermined distance "e" relative to the center plane "E" of the roll stack 1, in which reaction force F1 prevails. This arrangement may be termed a "pressure system." The resulting torque presses the guide element 17 against the guideway 16.

If it is desired that the bearing, block 7 assume a lower operating position, the pivoted and 11 pivots downward. At the same time the bearing block 7 is pivoted counterclockwise around the joint 14 with reference to FIG. 1. The two movements result in the deflection control device 5 retaining its operational direction in the center plane "E".

Figure 2:
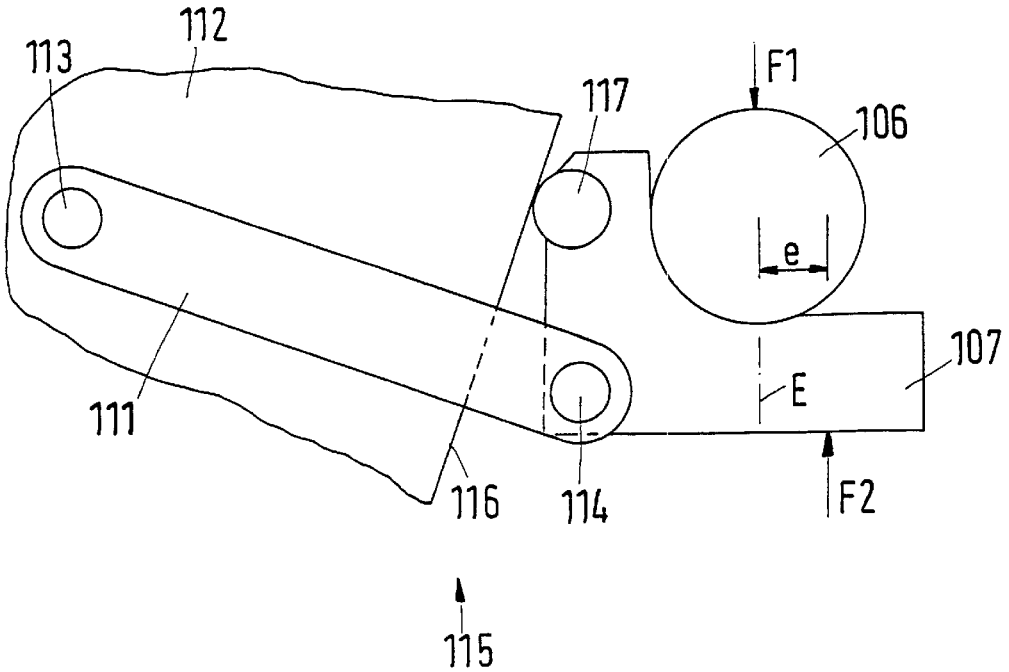
FIG. 2 shows a schematic representation of a second embodiment of the present invention.

FIG. 2 shows a second embodiment of the present invention with numbers for the corresponding elements in FIG. 1 being increased by 100. In this embodiment joint 114 is arranged between the pivoted arm 111 and the bearing block 107 beneath the axis of rotation of the lower roll. A guide element 117 in the form of a roller in contact with a guideway 116 is located above the joint 114. The guideway is constructed in a generally straight line and is arranged on a frame 112. In order for the guide clement to exert corresponding pressure on the guideway 116, the pressure system is arranged so that the loading force F2 is located at a predetermined distance "e" from the center plane "E" where reaction force F1 prevails. The resultant torque maintains contact of the guide element 117 with the guideway 116. The pivoted arm 111 moves in coordination with the opposing pivoting movement of the bearing block 107 here as well, so that in effect the operational direction of the deflection control device (not shown in FIG. 2) remains in the vertical plane "E".

Figure 3:
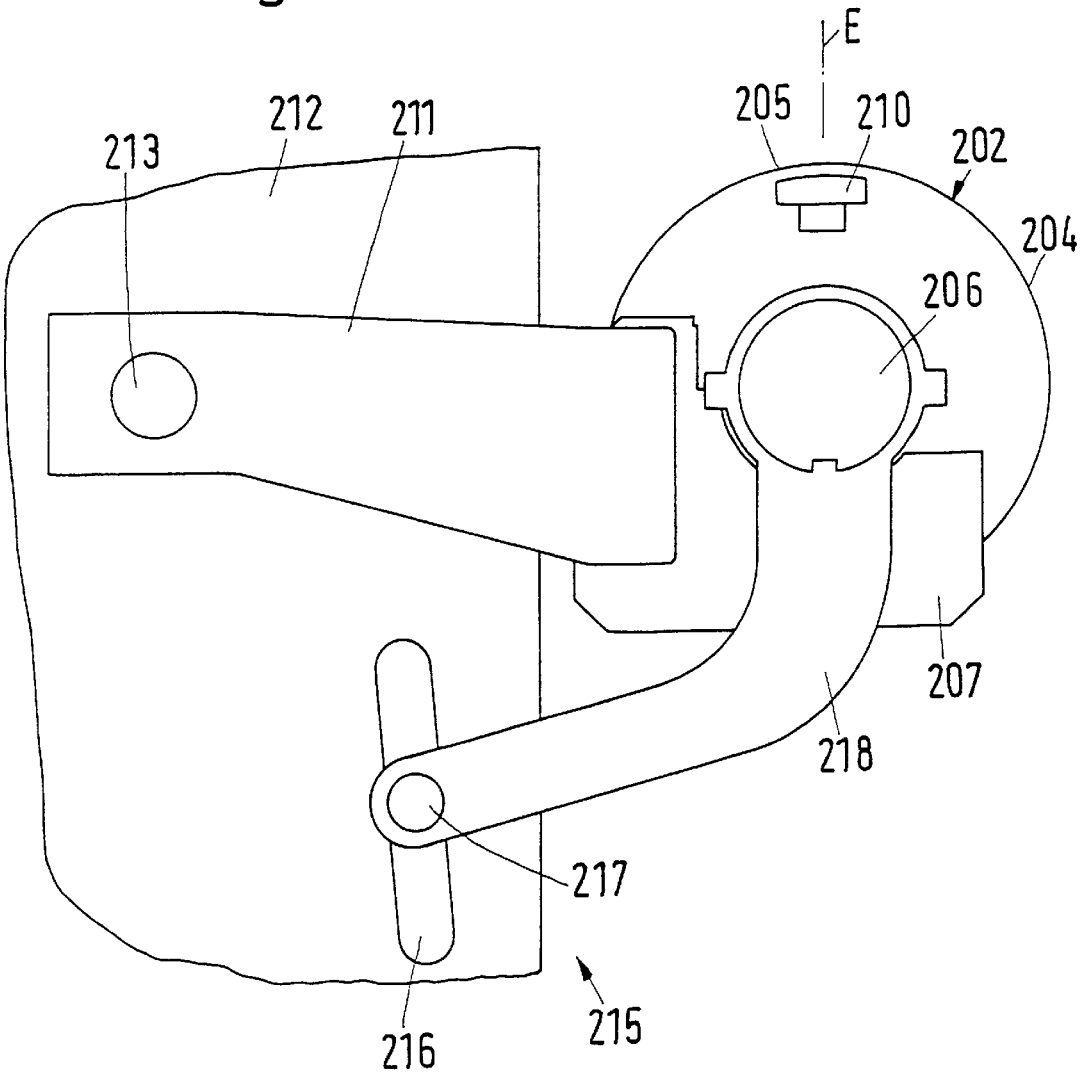
FIG. 3 shows a schematic representation of a third embodiment of the present invention.

In a third embodiment shown in FIGS. 3, numbers for the corresponding, elements in FIG. 1 are increased by 200. In this third embodiment, a bearing block 207 is rigidly attached to a distal end of a pivoted arm 211. The end of a bracket 206 is fixedly connected to a distal end of a correction lever 218. A proximal end of the correction lever has a guide element 217 in the form of a roller, which engages a guideway 216, the guideway being in the form of a groove.

Downward (i.e., clockwise from FIG. 3) movement of the pivoted arm 211 downwardly displaces guide element 217. At the same time bracket 206 is counterclockwise from FIG. 3 so that the forces result in the deflection control arrangement 205 maintaining its operational direction in the center plane "E" of the roll stack 1.

The angle between the guideway 216 and the center plane "E" of the roll stack 1 changes according to desired conditions. Small angles of approximately 10° or 15° may be created, as well as larger angles of approximately 20° to 30°.

Friction is very low in all embodiments because, as shown in the first and second embodiments of respective FIGS. 1 and 2, friction results only in the pivoting of the lever 11, and in movement of the guide elements 17, 117. In the third embodiment, the one joint of the pivoted arm is replaced by rotatability of the bracket 206 of the bearing block 207.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A calender, comprising:

a frame having a roll stack vertically arranged along a center plane therein;

a lower deflection control roll as the lowermost roll of said roll stack, said lower deflection roll comprising:

a) a sleeve supported on a bracket, said bracket having opposed ends; and b) a deflection control device configured to operate in the direction of the center plane of said roll stack;

a pair of bearing blocks, each said bearing block configured to hold a respective end of said bracket, each said bearing block being adjustable by a respective loading device;

a pair of pivoted arms each having a proximal end and a distal end, said proximal end swivelly connected to said frame, and said distal end connected to a respective bearing block; and a correction device having a guide element configured for translational movement along a guideway formed on said frame, said correction device adapted to adjust at least one of said bearing blocks;

wherein the direction of operation of said deflection control device remains substantially constant during adjustment of said at least one of said bearing blocks by said correction device.

2. The calender according to claim 1, wherein said guideway is attached to said frame, and wherein said guide element is adapted to be moved with said bearing block.

3. The calender according to claim 1, wherein said bearing block is swivelly attached to said pivoted arm and wherein said guide element of said correction device is mounted to said bearing block.

4. The calender according to claim 1, wherein said guideway comprises a slot including a pair of opposed sides.

5. The calender according to claim 1, wherein said guideway is a bearing surface against which the guide element is held by a pressure system.

6. The calender according to claim 5, wherein said pressure system comprises said loading device adapted to apply a force on said bearing block at a position outside a vertical center plane of said lower deflection control roll.

7. The calender according to claim 1, wherein said guideway is linear and is configured to form an angle of approximately 10° to 15° with the center plane of said roll stack.

8. The calender according to claim 1, wherein said guide element is a roller.

9. A calender, comprising:

a frame having a roll stack vertically arranged along a center plane therein;

a lower deflection control roll as the lowermost roll of said roll stack, said lower deflection roll comprising:

a) a sleeve supported on a bracket, said bracket having opposed ends; and b) a deflection control device configured to operate in the direction of the center plane of said roll stack;

a pair of bearing blocks, each said bearing block configured to hold a respective end of said bracket, each said bearing block being adjustable by a respective loading device;

a pair of pivoted arms each having a proximal end and a distal end, said proximal end swivelly connected to said frame, and said distal end connected to a respective bearing block; and a correction device having a guide element configured for translational movement along a guideway formed on said frame;

a correction lever fixedly connected to said bracket, said bracket adapted for rotation in said bearing block within a predetermined angle;

wherein said guide element of said correction device is mounted to said correction lever;

wherein said bearing block is fixedly connected to said pivoted arm; and wherein the direction of operation of said deflection control device remains substantially constant during adjustment of said at least one of said bearing blocks by said correction device.

10. A method of operating a calender, the calender having a frame having a roll stack therein, the roll stack being vertically arranged along a center plane, a lower deflection control roll as the lowermost roll of the roll stack, the lower deflection roll having a sleeve supported on a bracket, the bracket having opposed ends, the lower deflection control roll further having a deflection control device configured to operate in the direction of the center plane of the roll stack, the calender further having a pair of bearing blocks, each bearing block configured to hold a respective end of the bracket, each bearing block being adjustable by a respective loading device, a pair of pivoted arms each having a proximal end and a distal end, the proximal end swivelly connected to the frame, and the distal end connected to a respective bearing block, and a correction device having a guide element configured for translational movement along a guideway formed on the frame, the correction device adapted to adjust at least one of the bearing blocks, the method comprising:

adjusting, via the correction device, the bearing block; and maintaining the direction of operation of the deflection control device substantially constant.

11. The method of operating a calender according to claim 10, wherein the guideway is attached to the frame, the method further comprising moving the guide element with the bearing block.

12. The method of operating a calender according to claim 10, wherein the bearing block is swivelly attached to the pivoted arm and wherein the guide element of the correction device is mounted to the bearing block.

13. The method of operating a calender according to claim 10, wherein the guideway comprises a slot including a pair of opposed sides.

14. The method of operating a calender according to claim 10, wherein the guideway is a bearing surface, the method further comprising holding the guide element, via a pressure system, against the bearing surface.

15. The method of operating a calender according to claim 14, wherein the holding the guide element via a pressure system comprises applying force on a bearing block at a position outside the center plane of the lower deflection control roll.

16. The method of operating a calender according to claim 10, wherein the guideway is linear, the method further comprising forming an angle of approximately 10° to 15° between the guideway and the center plane of the roll stack.

17. The method of operating a calender according to claim 10, wherein the guide element is a roller.

18. A method of operating a calender, the calender having a frame having a roll stack therein, the roll stack being vertically arranged along a center plane, a lower deflection control roll as the lowermost roll of the roll stack, the lower deflection roll having a sleeve supported on a bracket, the bracket having opposed ends, the lower deflection control roll further having a deflection control device configured to operate in the direction of the center plane of the roll stack, the calender further having a pair of bearing blocks, each bearing block configured to hold a respective end of the bracket, each bearing block being adjustable by a respective loading device, a pair of pivoted arms each having a proximal end and a distal end, the proximal end swivelly connected to the frame, and the distal end connected to a respective bearing block, a correction device having a guide element configured for translational movement along a guideway formed on the frame, and a correction lever fixedly connected to the bracket, wherein the guide element of the correction device is mounted to the correction lever; and wherein the bearing block is fixedly connected to the pivoted arm, the method comprising:

adjusting the bearing block via said respective loading device;

rotating the bracket in the bearing block by an angle via said correction device, and maintaining the direction of operation of the deflection control device substantially constant.

* * * * *